US009705230B2

(12) United States Patent
Siller et al.

(10) Patent No.: US 9,705,230 B2
(45) Date of Patent: Jul. 11, 2017

(54) PLUG COVER STORAGE AND REMOVAL DEVICE

(71) Applicant: Plug Pal, LLC, Cincinnati, OH (US)

(72) Inventors: Sharon A. Siller, Cincinnati, OH (US); Tom Krieg, Cincinnati, OH (US); Lee Krieg, Cincinnati, OH (US)

(73) Assignee: Plug Pal, LLC, Cincinnati, OH (US)

( * ) Notice: Subject to any disclaimer, the term of this patent is extended or adjusted under 35 U.S.C. 154(b) by 0 days.

(21) Appl. No.: 15/146,034

(22) Filed: May 4, 2016

(65) Prior Publication Data

US 2016/0329652 A1 Nov. 10, 2016

Related U.S. Application Data

(60) Provisional application No. 62/157,510, filed on May 6, 2015.

(51) Int. Cl.
*H01R 13/44* (2006.01)
*H01R 13/443* (2006.01)
*B25B 27/02* (2006.01)

(52) U.S. Cl.
CPC ..... *H01R 13/443* (2013.01); *B25B 27/02* (2013.01)

(58) Field of Classification Search
CPC ..... H01R 13/6335; H01R 2103/00; H01R 24/28; G02B 6/3893; G02B 6/3898
USPC ..... 439/484, 148
See application file for complete search history.

(56) References Cited

U.S. PATENT DOCUMENTS 1,618,723 A 2/1927 Pearson
1,765,035 A * 6/1930 Stubbs ..... H01R 13/562 439/447
2,438,143 A * 3/1948 Brown ..... H01R 13/72 174/66
2,476,735 A 7/1949 Johnson
2,559,151 A 7/1951 Getzoff
2,977,564 A * 3/1961 Civitelli ..... H01R 13/633 191/12 R
2,997,564 A 8/1961 Gennaro
3,160,947 A * 12/1964 Sunderlin ..... H01R 13/6335 16/426
3,220,078 A 11/1965 Preziosi
(Continued)

OTHER PUBLICATIONS

Plug Pal, Design & Manufacture, downloaded from http://plugpal.co.uk/design.html, May 27, 2014.

*Primary Examiner* — Abdullah Riyami
*Assistant Examiner* — Vladimir Imas
(74) *Attorney, Agent, or Firm* — Frost Brown Todd LLC

(57) ABSTRACT

A plug cover removal and storage device includes a body. The body includes a first end portion and a second end portion. At least one of the first or second end portions comprise a curvilinear edge. One of first and second side portions is concave relative to a longitudinal axis of the body. The other of the first and second side portions is convex relative to the longitudinal axis. The body further includes a bottom surface extending between the first and second end portions and the first and second side portions and opposing a top surface. The body further includes a tapered portion extending between the curvilinear edge and at least one of the top and bottom surfaces. The body further includes at least one aperture in the body, wherein the at least one aperture is sized and configured to receive a prong of a plug cover.

20 Claims, 12 Drawing Sheets

(56) References Cited

U.S. PATENT DOCUMENTS 3,431,535 A 3/1969 Munyon
3,844,012 A 10/1974 Sturtevant
4,210,377 A * 7/1980 La Voque ..... H01R 13/6335 439/484
4,530,556 A 7/1985 Bonus
4,586,765 A 5/1986 Ban
4,662,697 A 5/1987 Moses
4,743,206 A * 5/1988 Imhoff ..... H01R 13/447 174/67
5,017,148 A * 5/1991 Buckshaw ..... H01R 13/443 439/135
5,062,803 A * 11/1991 Howard ..... H01R 13/6335 439/160
5,096,430 A * 3/1992 D'Amico ..... H01R 13/443 174/67
5,236,369 A 8/1993 Beach et al.
5,320,542 A 6/1994 Cheng
D351,373 S 10/1994 Barton
5,375,728 A * 12/1994 West ..... H02G 3/14 174/488
5,469,614 A 11/1995 Lyonnais
D369,074 S 4/1996 Durand
5,516,305 A 5/1996 Haluska
5,586,906 A * 12/1996 Staros ..... H01R 13/6335 439/320
5,752,850 A * 5/1998 Ziegler ..... H01R 13/6335 439/484
5,813,873 A * 9/1998 McBain ..... H01R 13/443 439/145
5,837,937 A * 11/1998 Reese ..... H02G 3/14 174/66
D404,984 S 2/1999 Skinner
5,947,755 A * 9/1999 Conway ..... H01R 13/447 439/148
6,443,753 B1 * 9/2002 Bludis ..... H01R 13/639 439/373
6,454,581 B1 * 9/2002 Ribeiro ..... B65D 39/00 439/135
6,808,410 B1 * 10/2004 Lee ..... H01R 12/592 439/484
7,041,905 B1 5/2006 Stewart
7,056,145 B2 6/2006 Campbell, III et al.
7,094,080 B2 8/2006 Dickie et al.
D533,837 S 12/2006 Wang
D582,228 S 12/2008 Ordoukhanian
7,572,993 B2 * 8/2009 Chen ..... H01R 13/5213 200/302.1
D639,248 S * 6/2011 Thornton ..... D13/139.1
8,088,999 B1 1/2012 Payou
8,093,497 B2 1/2012 White
8,152,554 B2 4/2012 Chapel et al.
8,771,006 B1 * 7/2014 Blinson ..... H01R 13/6335 439/484
9,054,455 B2 * 6/2015 Llewellyn, III ... H01R 13/6335
D764,417 S * 8/2016 Siller ..... D13/156
2003/0124900 A1 7/2003 O'Malley
2008/0196244 A1 8/2008 Miglin
2008/0266762 A1 * 10/2008 Ho ..... H01R 13/60 361/752
2009/0042425 A1 * 2/2009 Boerner ..... H01R 13/6335 439/160
2015/0056831 A1 * 2/2015 Llewellyn, III ... H01R 13/6335 439/152

* cited by examiner

PLUG COVER STORAGE AND REMOVAL DEVICE

PRIORITY

This application claims priority to U.S. Provisional Patent Application Ser. No. 62/157,510, filed May 6, 2015, entitled "Plug Cover Storage and Removal Device," the disclosure of which is incorporated by reference herein.

BACKGROUND

To reduce the risk of children being electrically shocked, parents or other adults may utilize safety plug covers in electrical outlets. Such plug covers provide a cover for the outlet and thereby prevent a child from inserting objects into the outlet. When a user desires to remove the plug cover to utilize the electrical outlet, the user may have difficulties removing the plug cover. Where there is close engagement between the flange of the plug cover and the wall plate, for example, a user may be unable to remove the plug cover. In attempts to remove the plug cover, the user may break one or more of his or her fingernails. Moreover, in attempts to remove the plug cover, the user may stay bent over for an extended period of time, risking injury to his or her back, for example Once the plug cover is finally removed from the outlet, the user may insert the plug into the outlet and use an appliance or other apparatus requiring electrical power. Once the user has finished utilizing the outlet, the user may forget to replace the plug cover, thus leading to the risk of electrical shock associated with an uncovered or unprotected outlet.

It is believed that no one prior to the inventor(s) has made or used the invention described herein.

BRIEF DESCRIPTION OF THE DRAWINGS

The accompanying drawings, which are incorporated in and constitute a part of this specification, illustrate embodiments of the invention, and, together with the general description of the invention given above, and the detailed description of the embodiments given below, serve to explain the principles of the present invention.

Figure 1:
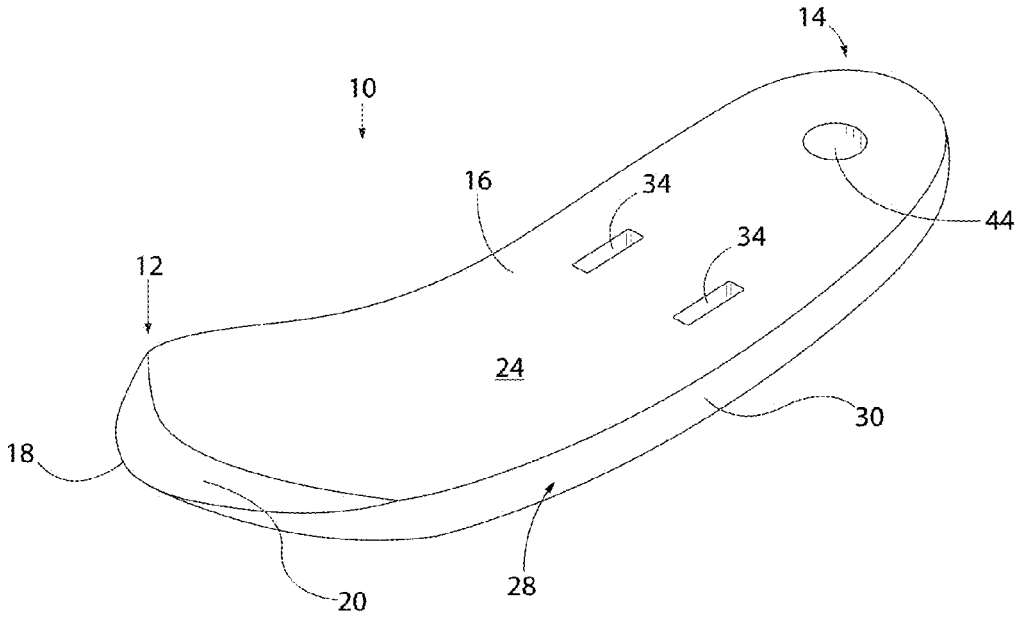
FIG. 1 depicts a front perspective view of an exemplary plug cover removal and storage device.
Figure 2:
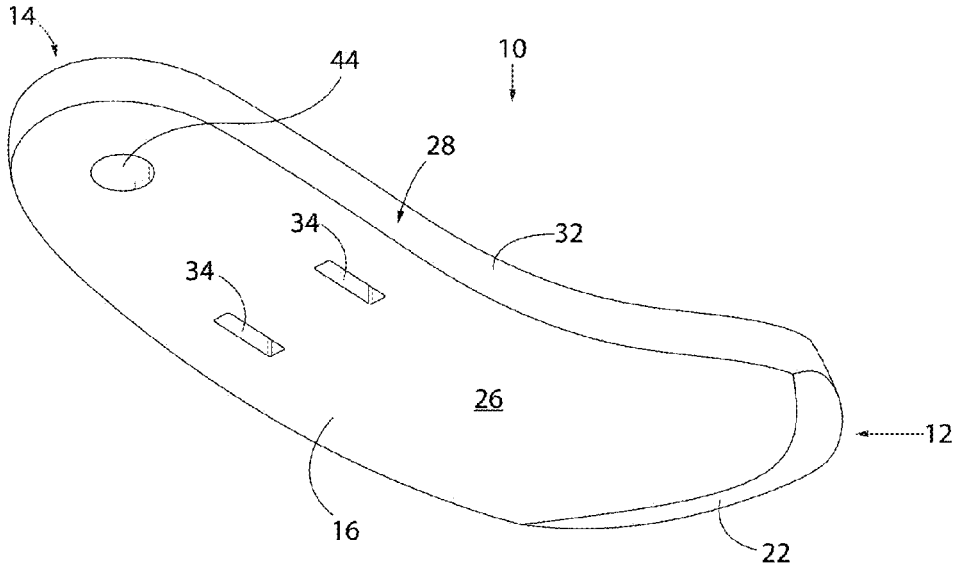
FIG. 2 depicts a rear perspective view of the device of FIG. 1.
Figure 3:
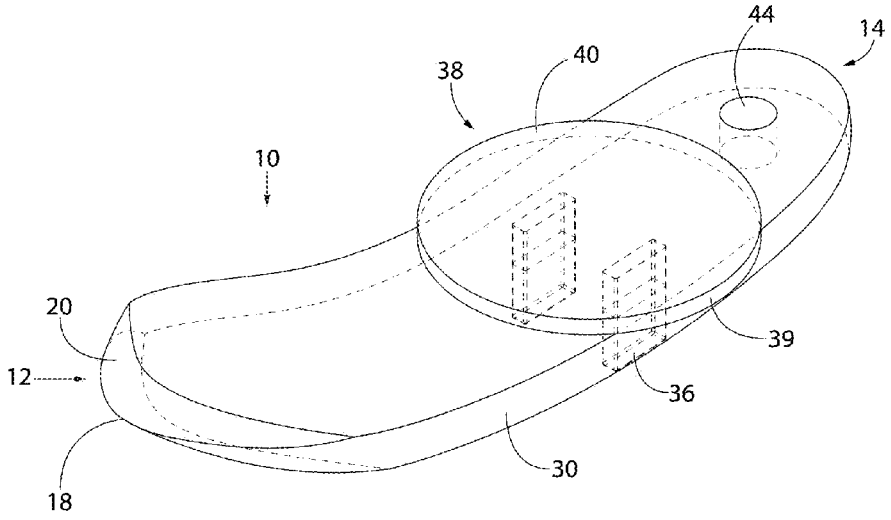
FIG. 3 depicts a front perspective view of the device of FIG. 1, showing an exemplary plug cover inserted into the storage feature thereof.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the present invention, and together with the description serve to explain the principles of the invention; it being understood, however, that this invention is not limited to the precise arrangements shown.

DETAILED DESCRIPTION

The following description of certain examples of the invention should not be used to limit the scope of the present invention. Other examples, features, aspects, embodiments, and advantages of the invention will become apparent to those skilled in the art from the following description, which is by way of illustration, one of the best modes contemplated for carrying out the invention. As will be realized, the invention is capable of other different and obvious aspects, all without departing from the invention. Accordingly, the drawings and descriptions should be regarded as illustrative in nature and not restrictive.

FIGS. 1-9 show an embodiment of plug cover removal and storage device (10) that includes features for removing a plug cover from an electrical wall outlet, and also for storing the removed plug cover while the outlet is being utilized. Device (10) includes a first end (12), a second end (14), and a body (16) that is configured to be gripped by a user. In the present embodiment, body (16) is a single, unitary member, but in other embodiments, body (16) may comprise multiple portions, components, etc., that may be coupled together in manners that will be apparent to persons skilled in the art in view of the teachings herein. First end (12) includes a tapered, leading edge (18). Leading edge (18) is positioned between top tapered portion (20) and bottom tapered portion (22). Top tapered portion (20), bottom tapered portion (22), and leading edge (18) form a wedge (23) having a taper angle (θ). In the example shown, the taper angle (θ) is approximately 34 degrees, but in other examples taper angle (θ) may be between approximately 10 degrees and approximately 65 degrees. In further examples, taper angle (θ) may be between approximately 30 degrees and approximately 40 degrees. Other suitable taper angles will be apparent to persons skilled in the art in view of the teachings herein. Wedge (23) configuration and taper angle (θ) are sufficient to allow wedge (23) to act as a lever between a plug cover (38) and a wall outlet cover or wall plate (64) (e.g., FIGS. 15-16) to disengage a plug cover (38) that is inserted into an outlet, as discussed in more detail below.

Figure 9:
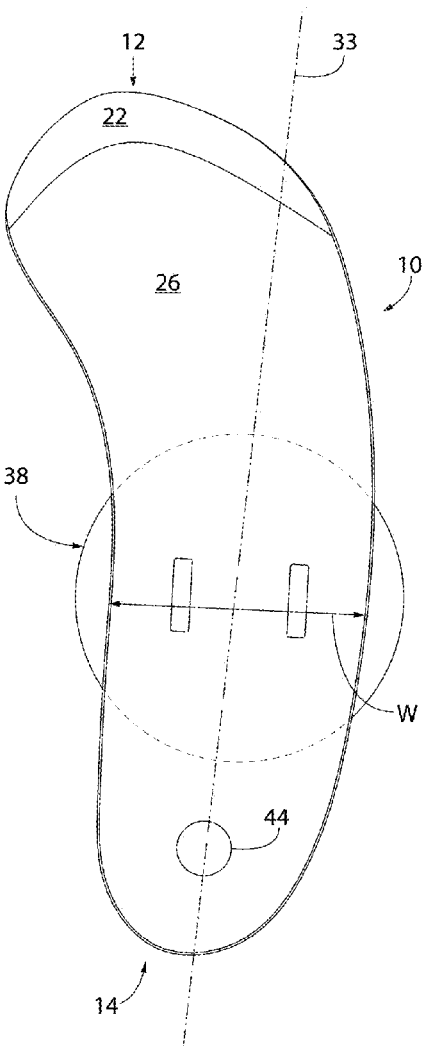
FIG. 9 depicts a bottom elevation view of the device of FIG. 1, showing the exemplary plug cover of FIG. 3 inserted into the storage feature.
Figure 10:
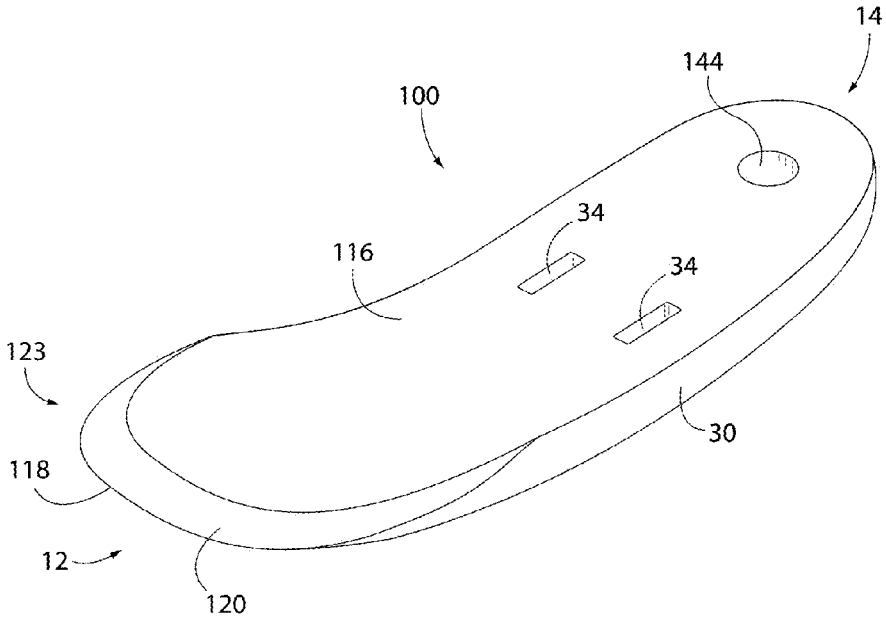
FIG. 10 depicts a front perspective view of an exemplary alternative plug cover removal and storage device.
Figure 11:
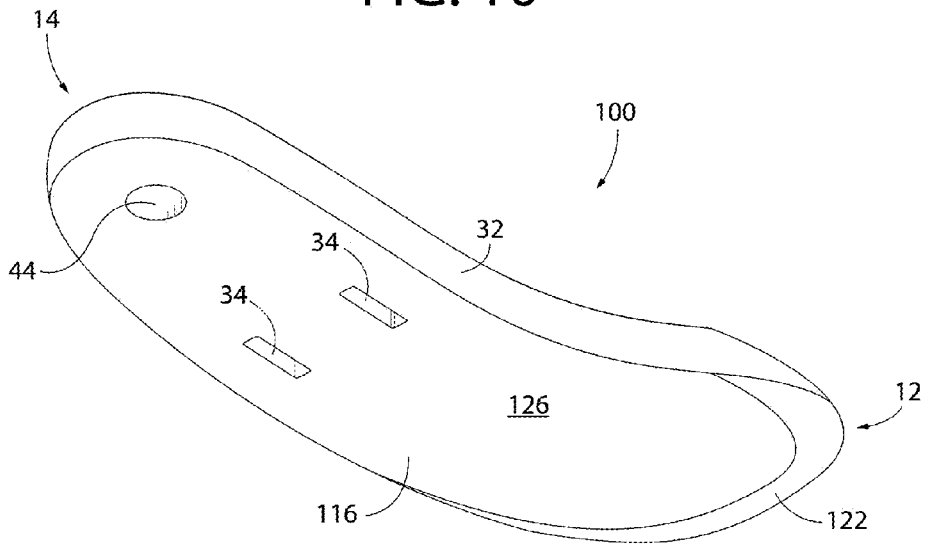
FIG. 11 depicts a rear perspective view of the device of FIG. 10.
Figure 12:
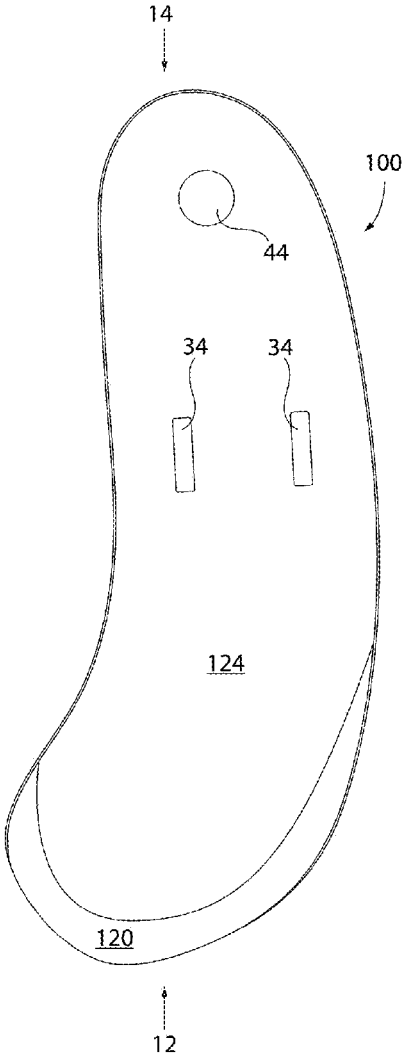
FIG. 12 depicts a top elevation view of the device of FIG. 10.
Figure 13:
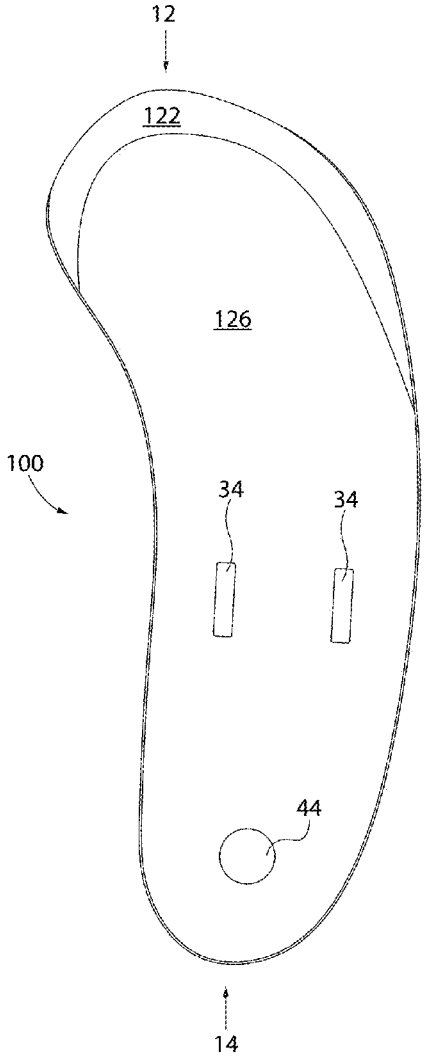
FIG. 13 depicts a bottom elevation view of the device of FIG. 10.

Top tapered portion (20) extends from a top surface (24) of device (10) and bottom tapered portion (22) extends from bottom surface (26) of device (10). As shown, top and bottom surfaces (24, 26) each comprise a planar face. However, in other embodiments, top surface (24) and/or bottom surface (26) may comprise different features or shapes or may include surface treatments or coatings. A side edge (28) extends between top and bottom surfaces (24, 26) and terminates on each side (30, 32) at the tapered portions (20, 22). First side (30) is defined in part by a curvilinear portion of edge (28) that extends away from an imaginary axis (33) along which at least a portion of body (16) extends. Thus, as shown in the present example, a portion of first side (30) of device is generally convex relative to axis (33) (FIG. 9). Second side (32) is defined in part by another curvilinear portion of edge (28) that extends towards axis (33). Thus, as shown in the present example, a portion of second side (32) of device (10) is generally concave relative to axis. Therefore, the first and second sides (30, 32) are shaped corresponding to a user's grip, such that the user's fingers may grasp the concave second side (32) while the convex second side (30) may rest in the user's palm. In addition or in the alternative, one or both the first and second sides (30, 32) may include contours shaped for receiving individual fingers, for example. Due to the configuration of the device (10) of the present example including both top and bottom tapered portions (20, 22), device (10) may be used comfortably and effectively in the left hand or right hand of a user.

Device (10) includes a storage feature comprising a pair of slots (34) that correspond to the shape and size of typical plug prongs, or typical prongs of a plug cover, for example. In the example shown, device (10) includes two slots that are configured to receive corresponding prongs (36) of plug cover (38). However, in other examples, device (10) may include a different number of slots (34), such as one or more than two, and may include differently shaped slots (34) than the generally rectangular shape shown to accommodate for different styles of plug covers (e.g., plug covers that are configured according to the different configurations of outlets, such as those found in countries other than the United States). Moreover, device (10) in other examples may be adapted for use with multiple styles of plug covers; i.e., a single device (10) may include multiple storage features comprising sets of differently configured slots to accommodate for several different styles of plug covers. Furthermore, in some examples, device (10) may include multiple different or identical storage features (e.g., multiple sets of slots (34)) to accommodate more than one plug cover (38). Other suitable configurations of the storage feature will be apparent to person skilled in the art in view of the teachings herein.

In the example shown, slots (34) are sized and configured to frictionally receive prongs (36) of plug cover (38). Thus, absent a removal force from a user, for example, slots (34) are configured to maintain a frictional engagement with prongs (36) of plug cover (38). However, upon application of a sufficient removal force from a user, plug cover (38) may be removed from engagement with slots (34). In the example shown, slots (34) are configured to receive prongs (36) in the same manner that a wall outlet receives prongs (36) of plug cover (38) or prongs of a plug (that is, prongs (36) are inserted into slots (34) along a path that is parallel to the longitudinal axis of each prong (36)). As shown, plug cover (38) includes a flange (39) having a first side (40) and a second side (42) from which prongs (36) extend. Second side (42) substantially abuts top surface (24) of device (10). Alternatively, second side (42) may abut bottom surface (26) when engaged in slots (34) in an opposite manner. Further alternatively, second side (42) may not abut either surface (24, 26), such as when prongs (36) are only partially inserted into slots (34). In alternative examples, however, the storage feature may be configured to receive prongs (36) in a different manner than that shown, or engage a different portion of plug cover (38). Other suitable configurations of storage feature will be apparent to persons skilled in the art in view of the teachings herein.

Device (10) of the present example is configured to allow for the easy removal of plug cover (38) from storage feature of device (10). Particularly, in the example shown, the width (w) of the portion of device (10) coincident with or adjacent to slots is less than a cross-sectional dimension (e.g., diameter) of plug cover (38). Thus, when a user desires to remove plug cover (38) from device (10), the user may grasp the portions of plug cover (38) extending outwardly of edge (28) on first and second sides (30, 32). As shown, device (10) is configured such that the width (w) allows plug cover to extend outward (away from axis (33)) from edge (28) on both first and second sides (30, 32). However, in alternative examples, device may be configured such that the width (w) allows plug cover (38) to extend outward from only one of the first or second sides (30, 32). Alternatively, slots (34) may be positioned on device (10) such that a portion of plug cover (38) extends outwardly from edge (28) at a different portion of device (10), such as first end (12), second end (14), or a combination of ends (12, 14) and sides (30, 32). In further alternative examples, device (10) may be configured such that width (w) is greater than the cross-sectional dimension of plug cover (38) such that no portion of plug cover (38) extends outward from edge (28) on either of the first. Other suitable configurations of device, such as the position of slots, width (w), etc., to accommodate for the easy removal of plug cover (38) from slots (34) will be apparent to persons skilled in the art in view of the teachings herein.

Figure 4:
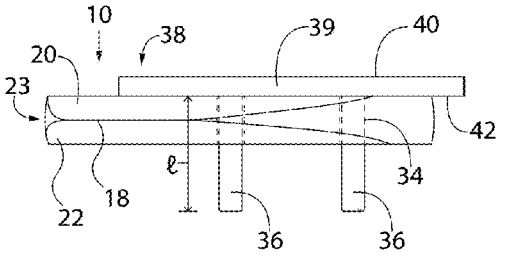
FIG. 4 depicts a front elevation view of the device of FIG. 1, showing the exemplary plug cover of FIG. 3 inserted into the storage feature.
Figure 5:
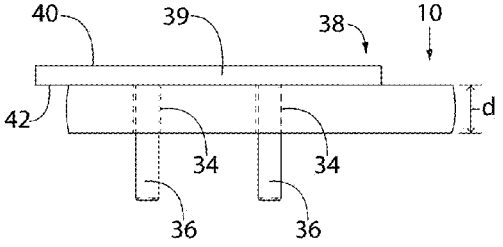
FIG. 5 depicts a rear elevation view of the device of FIG. 1, showing the exemplary plug cover of FIG. 3 inserted into the storage feature.
Figure 6:
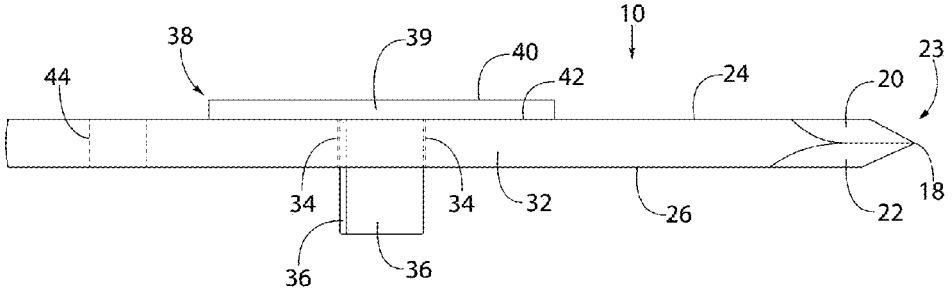
FIG. 6 depicts a left side elevation view of the device of FIG. 1, showing the exemplary plug cover of FIG. 3 inserted into the storage feature.
Figure 7:
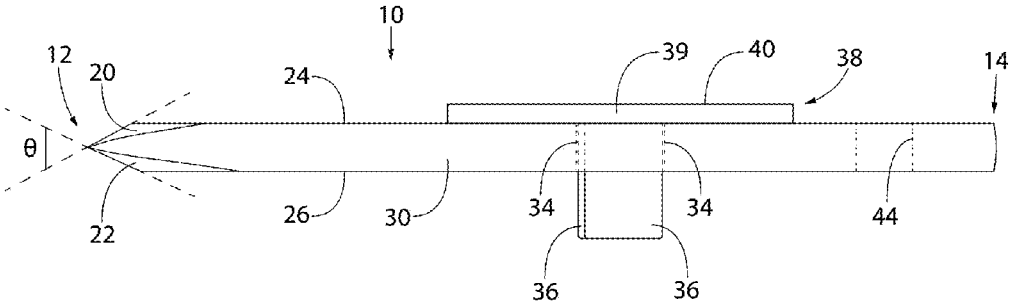
FIG. 7 depicts a right side elevation view of the device of FIG. 1, showing the exemplary plug cover of FIG. 3 inserted into the storage feature.
Figure 8:
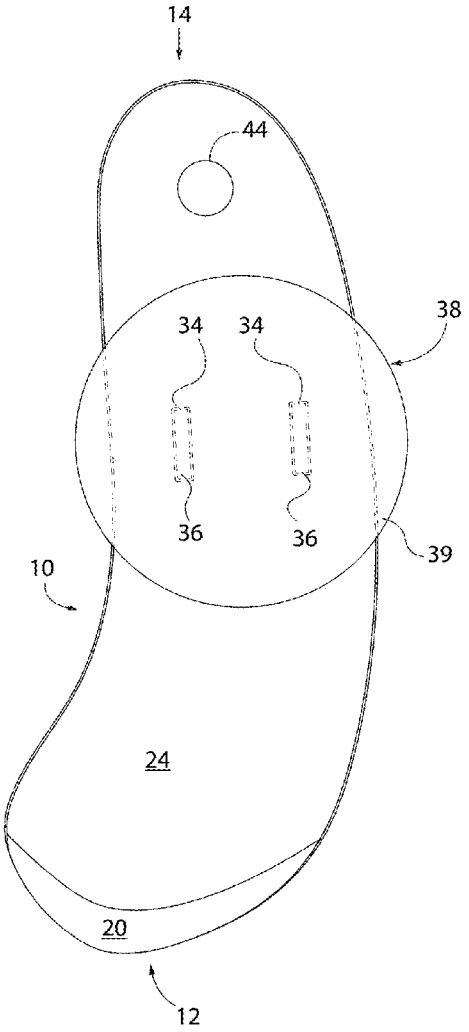
FIG. 8 depicts a top elevation view of the device of FIG. 1, showing the exemplary plug cover of FIG. 3 inserted into the storage feature.

As shown in FIGS. 4-5, device (10) of the present example includes a thickness or depth (d) that is less than the length (l) of prongs (36). Thus, when the plug cover (38) is inserted into slots (34) at the top surface (24) (or until plug cover (38) otherwise bottoms out against device (10)), the free ends of prongs (36) extend past bottom surface (26). Similarly, when the plug cover (38) is inserted into slots at the bottom surface (26), prongs (36) extend past top surface (24). Thus, the free ends of prongs (36) are accessible as an additional or alternative manner of removing plug cover (38) from device (10), i.e., the user may push prongs (36) relative to device (10) (in the opposite direction used for engaging the plug cover (38) and device (10)) in order to remove prongs (36) from slots (34). Other suitable configurations of device (10) to allow for easy and effective removal of plug cover (38) therefrom will be apparent to persons skilled in the art in view of the teachings herein.

Device (10) of the present example includes an aperture (44) near the second end (14) that allows a tether, for example, to be coupled to device (10) for storage of the device (10) on a power cord of an appliance, as discussed in more detail below. In some examples, however, aperture (44) may be positioned at a different location on the device (10). In other examples, in addition or in the alternative to aperture (44), device (10) may include a hook or other feature sufficient for securing a tether to device (10). Other suitable manners for storing device (10) relative to an appliance or power cord, for example, will be apparent to persons skilled in the art in view of the teachings herein.

FIGS. 10-13 show an alternative embodiment of a plug cover removal and storage device (100). Device (100) is substantially similar to device (10). Therefore, identical or substantially similar features are labeled with identical reference numerals without further discussion below. Device (100) is different than device (10) in that it includes top and bottom tapered portions (120, 122) that extend further into the body (116), particularly into the top surface (124) and bottom surface (126), respectively. Thus, wedge (123) is different than wedge (23) in that the top and bottom tapered portions (120, 122) include a greater surface area than tapered portions (20, 22). However, it will be understood that the use of device (100) will be substantially similar to device (10) described herein, as discussed below.

Figure 14:
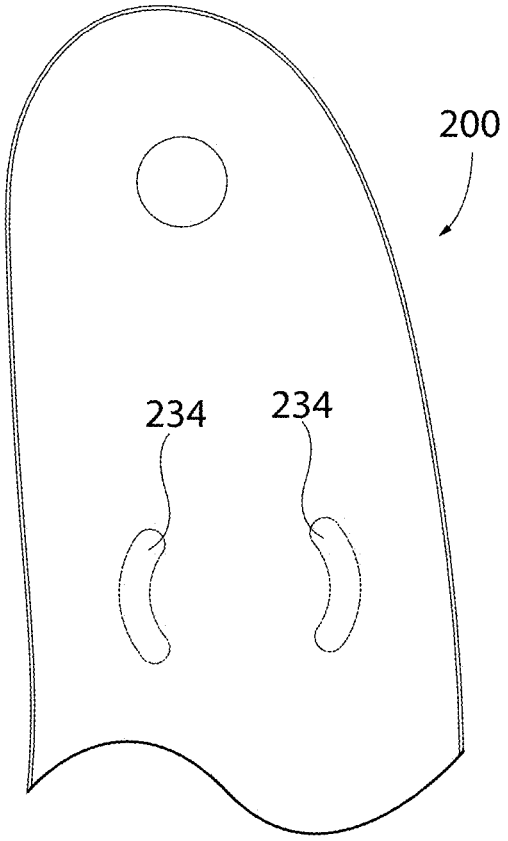
FIG. 14 depicts a portion of another exemplary alternative plug cover removal and storage device, including an exemplary alternative storage feature that is suitable for incorporation into the devices of FIGS. 1 and 10.

FIG. 14 shows a portion of another exemplary alternative plug cover removal and storage device (200). Device (200) is substantially similar to device (10, 100), except for the differences discussed below. Therefore, identical or substantially similar features are labeled with identical reference numerals without further discussion below. As shown, device (200) includes an exemplary alternative storage feature comprising curved slots (234). Slots (234) are sized and configured to frictionally receive prongs (36) of plug cover (38). As shown, the curvature of slots (234) aids in the frictional retention of slots. In the example shown, slots (234) are configured to receive prongs (36) in the same manner that a wall outlet receives prongs (36) of plug cover (38) or prongs of a plug (that is, prongs (36) are inserted into slots (234) along a path that is parallel to an axis defined by each prong (36)). In addition to providing an interference fit, the curvature of slots (234) provides retention forces that are perpendicular to axes defined by each prong (36), further aiding in the retention of prongs (36) within slots (234). In the present example, the radius of the curvature of the convex portion of each of slots (234) is approximately 0.292 inches and the radius of curvature of the concave portion of each of slots is approximately 0.208 inches. In other examples, the radius of curvature of the convex portion of each of slots (234) may be between approximately 0.200 inches and approximately 0.400 inches, while the radius of curvature of the concave portion of each of slots may be between approximately 0.150 inches and approximately 0.350 inches. Other suitable dimensions of slots (234) that provide frictional retention will be apparent to persons skilled in the art in view of the teachings herein.

Thus, absent a removal force from a user, for example, slots (234) are configured to maintain a frictional engagement with prongs (36) of plug cover (38). However, upon application of a sufficient removal force from a user, plug cover (38) may be removed from engagement with slots (234). As shown, each of slots (234) includes a curvature. However, in other examples, only one of slots (234) may include a curvature. Other suitable configurations of storage feature of device (200) will be apparent to persons skilled in the art in view of the teachings herein. While slots (234) are shown to be incorporated into device (200), it will be understood that slots (234) may be incorporated into device (10, 100), and that features of device (10, 100) may be incorporated into device (200).

In use, a user may take advantage of one or more features of the device (10, 100, 200) described above to remove plug covers from a wall outlet and/or store a removed plug cover. While an exemplary use is depicted in FIGS. 15-19 using device (10), it will be understood that the exemplary use, or other exemplary uses, may be carried out using any of devices (10, 100, 200).

Figure 15:
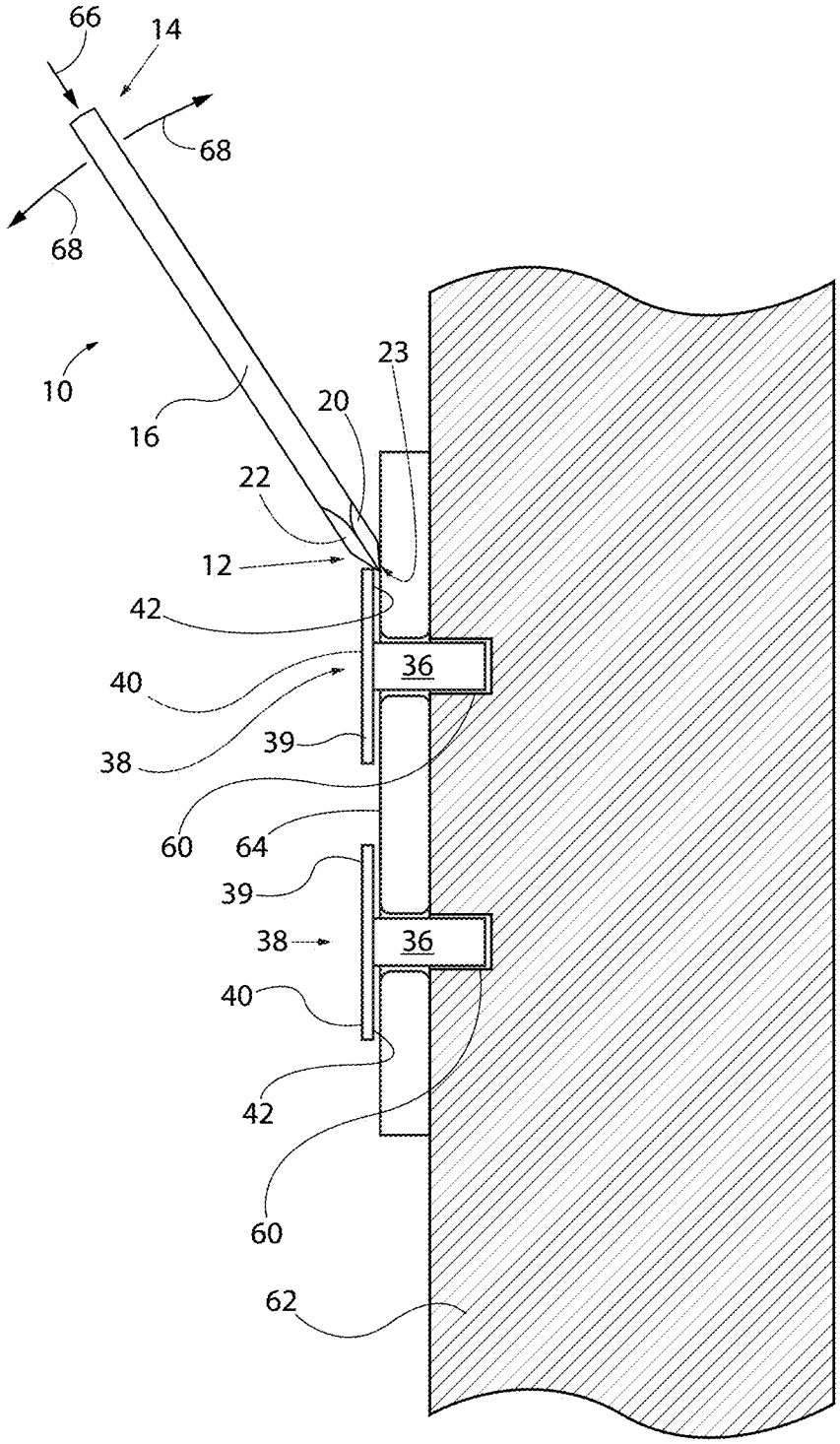
FIG. 15 depicts a side view, in partial cross-section, of the device of FIG. 1 being used to remove a plug cover from a wall outlet.

FIG. 15 shows a pair of plug covers (38), which may be identical or substantially similar to plug cover (38) described herein, inserted into respective wall outlets (60) of a wall (62). Plug covers (38) are shown to be inserted in the outlets (60) such that prongs (36) are within the outlet (60), such that first side (40) of flange (39) of each plug cover (38) faces away from the wall (62) and second side (42) of flange (39) of each plug cover (38) generally abuts the wall plate (64). Of course, outlets (60) may be configured such that there is no wall plate (64) or wall (62). It will be understood that the methods associated with withdrawing plug cover (38) from an outlet (60) configured differently than the outlet (60) shown may be modified according to the differences in such outlet configurations.

In the present example, when the user desires to access one of the outlets (60) to, for example, insert a plug (66) of an appliance (not shown), the user may grasp the device (10) and use wedge portion (23) to pry the plug cover (38) away from the wall plate (64). Particularly, in the example shown, device (10) is engaged with wall plate (64) such that leading edge (18) is placed adjacent to the abutment (i.e., meeting point) between the second side (42) of plug cover (38) and wall plate (64). More particularly, as shown in FIG. 15, top tapered portion (20) generally abuts wall plate (64), while bottom tapered portion (22) generally abuts a portion of flange (39) of plug cover (38).

Figure 16:
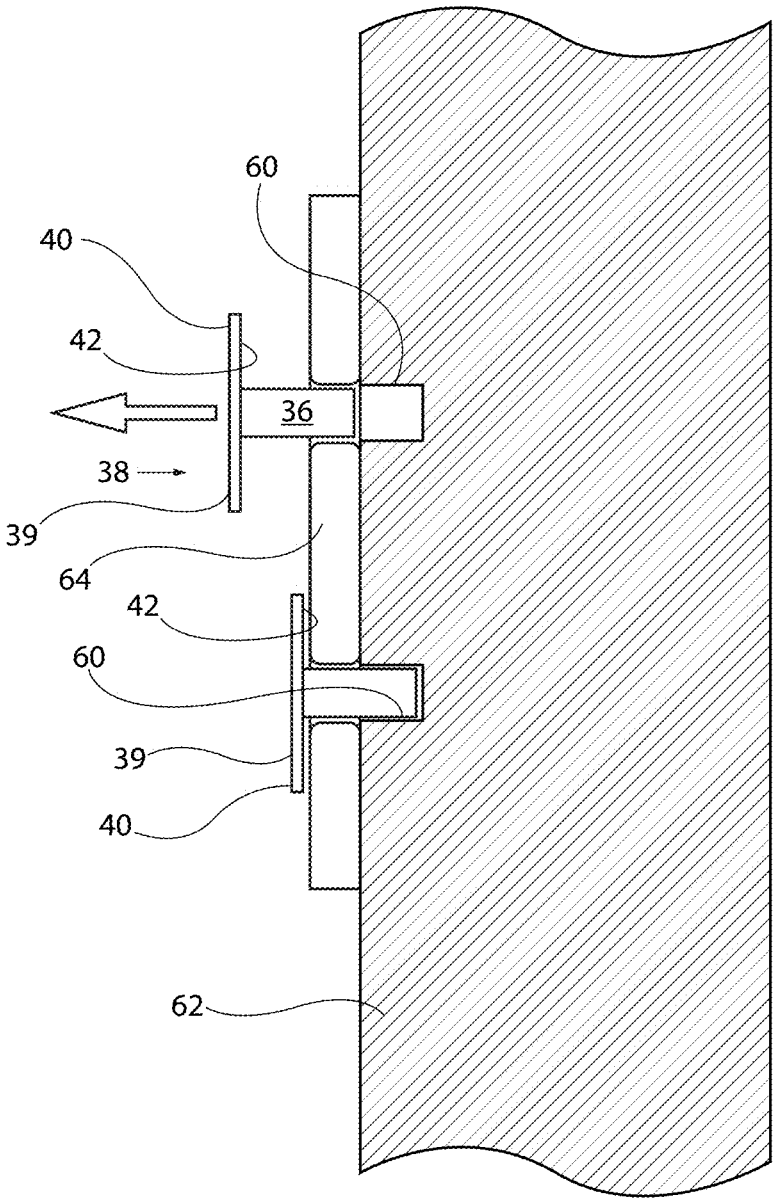
FIG. 16 depicts a side view, in partial cross-section, of a plug cover being removed from a wall outlet.

In order to cause the withdrawal of plug cover (38) from outlet (60), the user may direct the device (10) (in the direction of arrow (66), for example) such that wedge (23) is pushed between wall plate (64) and plug cover (38), thereby naturally drawing plug cover (38) away out of outlet (60). Thus, in the present example, wedge (23) and taper angle ($\theta$) are sufficient to allow for a camming force that causes the plug cover (38) to withdraw from outlet (60) when the wedge (23) is directed between plug cover (38) and wall plate (64). In other words, the camming force placed on plug cover (38) in a direction away from outlet (60) is caused by wedge (23) being directed between plug cover (38) and wall plate (64). The withdrawal, or partial withdrawal, of plug cover (38) may also be assisted by pivoting plug cover (38) (e.g., along a path defined by arrows (68)) simultaneously with, prior to, or after directing device in direction of arrow (66). In some examples, device (10) may be used to completely withdraw and remove plug cover (38) from outlet; however, in the example shown, device (10) is used to only partially withdraw plug cover (38), as shown in FIG. 16.

In some examples, device (10) may include additional features configured to completely withdraw and remove plug cover (38) from outlet (60) after wedge (23) is used to partially remove plug cover (38) from outlet (60). However, it is also contemplated that a user may completely withdraw and remove plug cover (38) from outlet using his or her hand, after the device (10) has been utilized to partially withdraw plug cover (38) from outlet. Other suitable manners of withdrawing a plug cover (38) from outlet (60) will be apparent to persons skilled in the art in view of the teachings herein.

Figure 17:
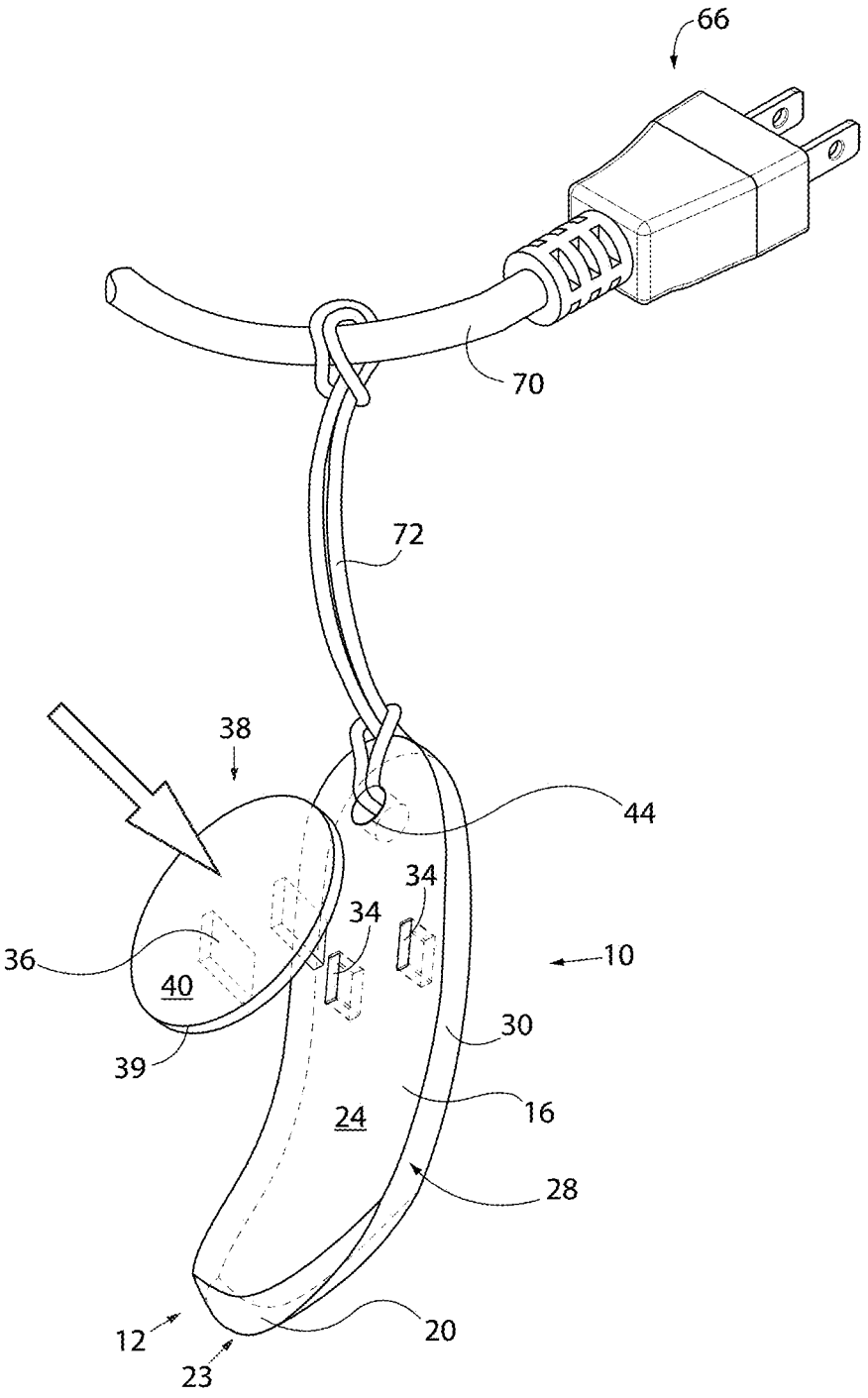
FIG. 17 depicts a side view of the device of FIG. 1 and a plug cover being directed into a storage feature of the device of FIG. 1, after the plug cover has been removed from a wall outlet.
Figure 18:
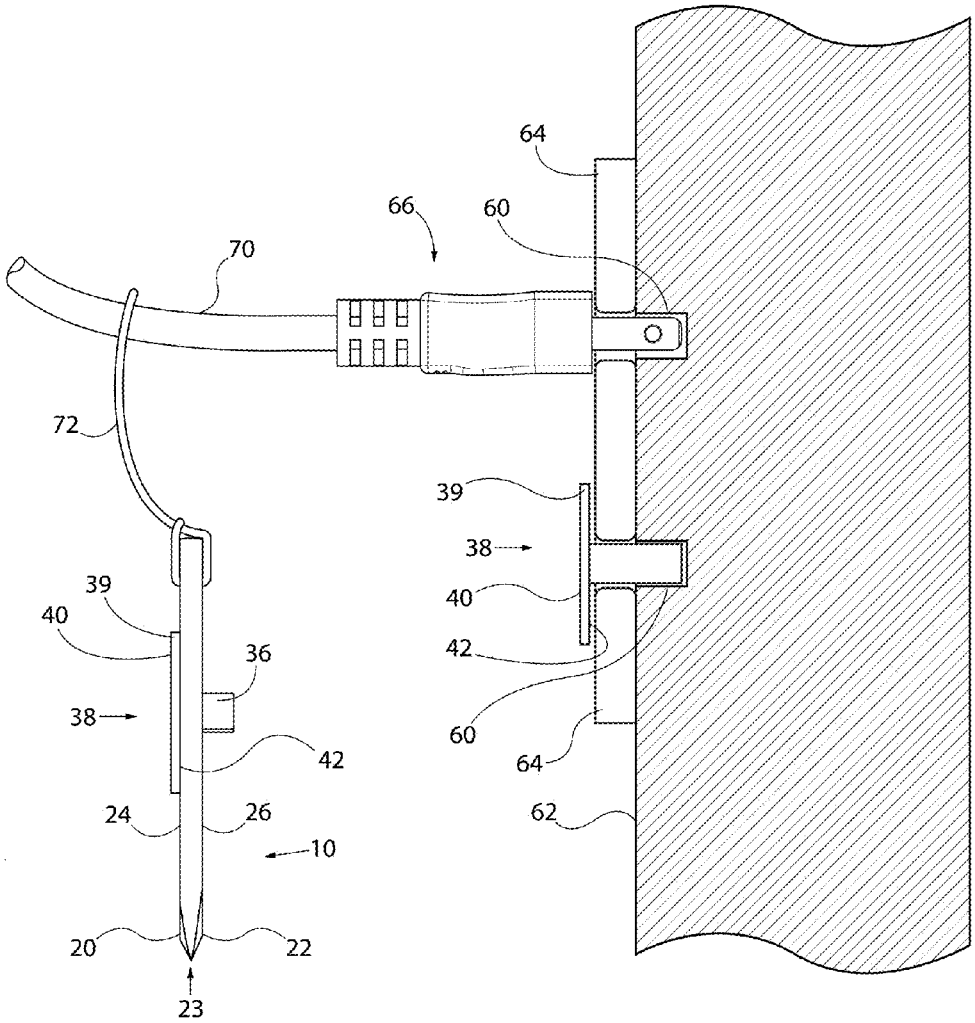
FIG. 18 depicts a side view, in partial cross section, of the plug cover being stored in a storage feature of the device of FIG. 1, showing the device being coupled to an electrical cord of a plug and the plug being inserted into a wall outlet.
Figure 19:
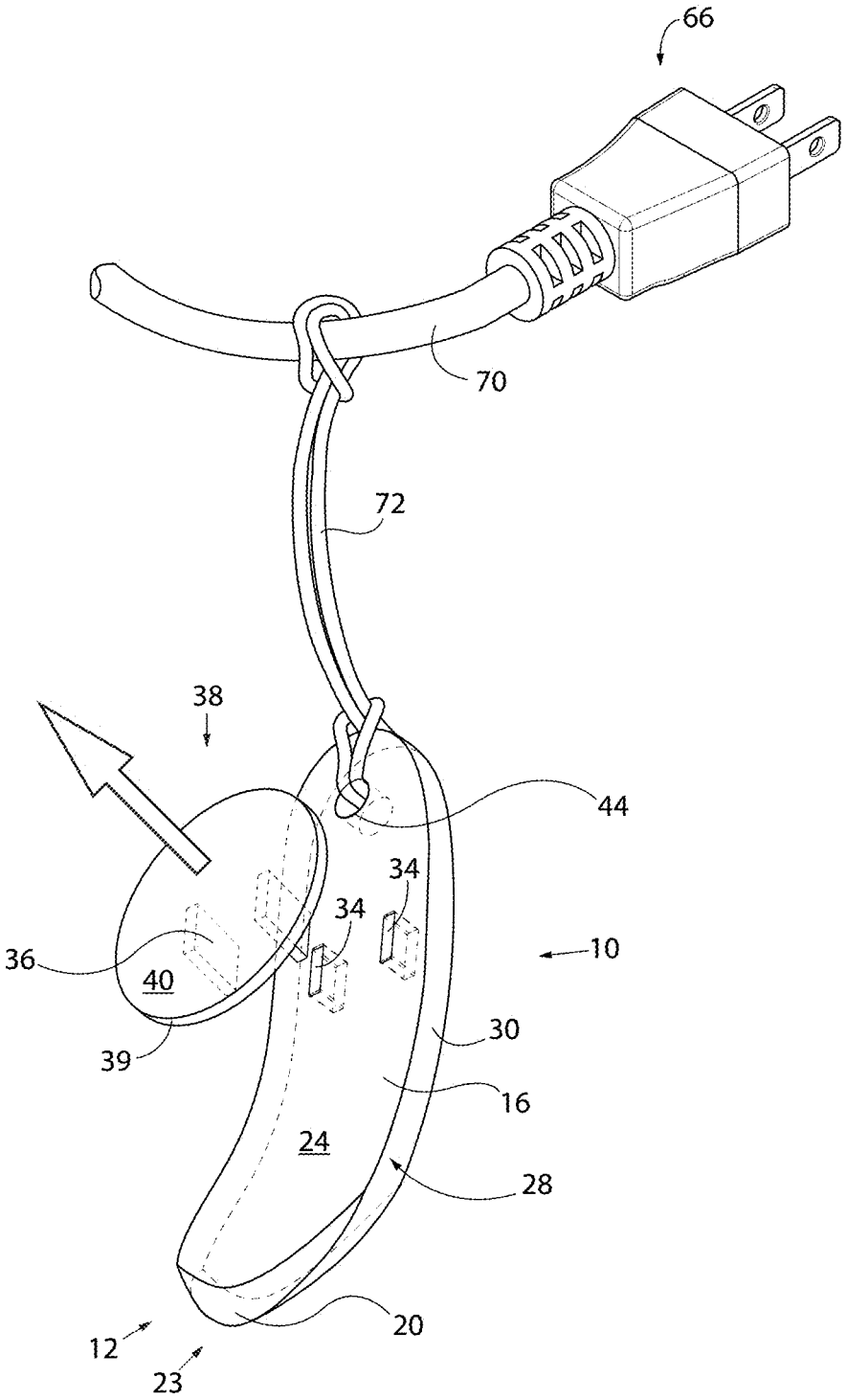
FIG. 19 depicts a perspective view of the device of FIG. 1, showing a plug cover being removed from the storage feature of the device.

Referring to FIG. 17, once plug cover (38) is removed from outlet (60), a user may direct plug cover (38) into storage feature of device (10) in one of the manners described above. The user may then direct plug (66) into outlet (60), with plug cover (38) stored in slots (34) of storage feature as described above, and with device (10) stored by being attached to cord (70) (via a tether, as discussed above) (FIG. 18). Once the user is done using appliance (not shown), for example, that is associated with cord (70), the user may remove plug (66) from outlet (60), remove plug cover from device (10) according to the disclosure above (see also FIG. 19), and replace plug cover (38) within outlet, as shown in FIG. 15, for example. Of course, the presence of plug cover (38) in storage feature near the end of cord (70) may serve as a reminder to the user to replace the plug cover (38) in outlet (60), thus mitigating or eliminating the risk of electrical shock and other issues discussed above.

Device (10, 100, 200) may be made of one or more various materials that are suitable for at least the uses described herein. For example, device (10, 100, 200) may comprise various types of polymers (thermoplastic or thermoset), including but not limited to PET, PE, HDPE, PVC and PC. Device (10, 100, 200) may additionally or alternatively comprise wood, ceramic, or other materials, such as a non-conductive metal. Device (10, 100, 200) may also comprise combinations of such materials described herein and/or of other materials suitable for at least the uses described herein. Device (10, 100, 200) may be manufactured according to methods understood by persons skilled in the art. For example, device (10, 100, 200) may be injection molded, CNC machined/milled, and/or made by other methods that will be understood to persons skilled in the art.

It should be understood that any of the versions of the instruments described herein may include various other features in addition to or in lieu of those described above. It should be understood that any one or more of the teachings, expressions, embodiments, examples, etc. described herein may be combined with any one or more of the other teachings, expressions, embodiments, examples, etc. that are described herein. The above-described teachings, expressions, embodiments, examples, etc. should therefore not be viewed in isolation relative to each other. Various suitable ways in which the teachings herein may be combined will be readily apparent to those of ordinary skill in the art in view of the teachings herein. Such modifications and variations are intended to be included within the scope of the claims.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometrics, materials, dimensions, ratios, steps, and the like discussed above are illustrative and are not required. Accordingly, the scope of the present invention should be considered in terms of the following claims and is understood not to be limited to the details of structure and operation shown and described in the specification and drawings.

We claim:

1. A plug cover removal and storage device, comprising:
(a) a body, wherein the body comprises:
(i) a first end portion,
(ii) a second end portion, wherein at least one of the first or second end portions comprises a curvilinear edge,
(iii) a first side portion,
(iv) a second side portion opposing the first side portion, wherein one of first and second side portions is concave relative to a longitudinal axis of the body, wherein the other of the first and second side portions is convex relative to the longitudinal axis,
(v) a top surface extending between the first and second end portions and the first and second side portions,
(vi) a bottom surface extending between the first and second end portions and the first and second side portions and opposing the top surface,
(vii) a tapered portion extending between the curvilinear edge and at least one of the top and bottom surfaces, wherein the tapered portion forms a wedge, and
(viii) at least one aperture in the body, wherein the at least one aperture is sized and configured to receive a prong of a plug cover.

2. The plug cover removal and storage device of claim 1, wherein the body is a unitary member.

3. The plug cover removal and storage device of claim 1, wherein the at least one aperture extends from the top surface to the bottom surface.

4. The plug cover removal and storage device of claim 1, wherein the tapered portion comprises a first taper extending between the curvilinear edge and the top surface, and a second taper extending between the curvilinear edge and the bottom surface.

5. The plug cover removal and storage device of claim 1, wherein the top and bottom surfaces each comprise a planar face.

6. The plug cover removal and storage device of claim 1, wherein the at least one aperture defines a longitudinal axis, wherein a portion of the aperture is concave or convex relative to the axis.

7. The plug cover removal and storage device of claim 6, wherein a first portion of the at least one aperture is concave relative to the axis, wherein a second portion of the at least one aperture is convex relative to the axis.

8. The plug cover removal and storage device of claim 1, further comprising a tether retaining feature.

9. The plug cover removal and storage device of claim 8, further comprising a tether attached to the tether retaining feature.

10. A system, comprising:
(a) a plug cover comprising:
(i) a plug cover body comprising a first width, and
(ii) at least one prong extending from the body; and
(b) a plug cover removal and storage device, the device comprising:
(i) a first end portion,
(ii) a second end portion, wherein at least one of the first and second end portions comprise a tapered portion, wherein the tapered portion terminates in a leading edge and forms a wedge,
(iii) a first side portion,
(iv) at least one slot, wherein the at least one slot is configured to receive the at least one prong of the plug cover, and
(v) a second side portion, wherein the device comprises a second width between portions of the first and second side portions that are coincident with the at least one slot, wherein the second width is less than the first width of the plug cover.

11. The system of claim 10, wherein at least a first portion of the plug cover body extends beyond the first side portion of the device when the at least one prong is positioned within the at least one slot.

12. The system of claim 11, wherein at least a second portion of the plug cover body extends beyond the second side portion of the device when the at least one prong is positioned within the at least one slot.

13. The system of claim 10, wherein the device defines a third width between portions of the first and second side portions that are not coincident with the at least one slot, wherein the third width is different than the second width.

14. The system of claim 10, wherein the second width is defined along an axis extending between the first and second side portions, wherein the axis extends perpendicular to the at least one prong.

15. The system of claim 10, wherein the device further comprises:

(i) a top surface extending between the first and second end portions and the first and second side portions, and (ii) a bottom surface opposing the top surface and extending between the first and second end portions and the first and second side portions;

wherein the device and the at least one prong are sized such that a free end of the at least one prong extends past the top or bottom surface when the at least one prong is positioned within the at least one slot.

16. The system of claim 15, wherein the device and the at least one prong are sized such that the free end of the at least one prong extends past the top or bottom surface when the at least one prong is positioned within the at least one slot and when the plug cover bottoms out against the device.

17. The system of claim 10, wherein the at least one slot is configured to frictionally hold the at least one prong such that the at least one prong remains within the at least one slot absent a sufficient removal force.

18. A plug cover removal and storage device comprising a body, wherein the body comprises:

(a) a first end portion, wherein the first end portion comprises a tapered edge that forms a wedge;

(b) a second end portion;

(c) a first side portion;

(d) a second side portion opposing the first side portion, wherein the body defines a width between the first and second side portions, wherein the width is variable along a length of the body; and (f) a plug cover storage feature, wherein the plug cover storage feature is configured to retain a plug cover relative to the body.

19. The plug cover removal and storage device of claim 18, wherein the first end portion, second end portion, first side portion, and second side portion each include a curvilinear profile.

20. The plug cover removal and storage device of claim 18, wherein the tapered edge extends along the first end portion and a part of at least one of the first and second side portions.

* * * * *